US007199302B2

(12) United States Patent
Räisänen

(10) Patent No.: US 7,199,302 B2
(45) Date of Patent: Apr. 3, 2007

(54) TRANSDUCER AND METHOD FOR FORMING A TRANSDUCER

(75) Inventor: Heikki Eero Räisänen, Jyväskylä (FI)

(73) Assignee: B-Band Oy, Vaajakoski (FI)

( * ) Notice: Subject to any disclaimer, the term of this patent is extended or adjusted under 35 U.S.C. 154(b) by 463 days.

(21) Appl. No.: 10/759,909

(22) Filed: Jan. 16, 2004

(65) Prior Publication Data

US 2004/0159224 A1 Aug. 19, 2004

Related U.S. Application Data

(63) Continuation of application No. 09/851,493, filed on May 8, 2001, now Pat. No. 6,689,948, which is a continuation-in-part of application No. 09/553,566, filed on Apr. 21, 2000, now Pat. No. 6,242,683, which is a continuation-in-part of application No. 09/155,828, filed on Oct. 6, 1998, now Pat. No. 6,078,006.

(51) Int. Cl.
*G10H 3/00* (2006.01)

(52) U.S. Cl. ..... 84/723; 84/725; 84/730

(58) Field of Classification Search ..... None
See application file for complete search history.

(56) References Cited

U.S. PATENT DOCUMENTS

| | | | | |
|---|---|---|---|---|
| 4,382,328 | A | 5/1983 | Janszen | |
| 4,654,546 | A | 3/1987 | Hirjavainen | |
| 5,123,325 | A | 6/1992 | Turner | |
| 5,204,487 | A | 4/1993 | Turner | |
| 5,319,153 | A | 6/1994 | Fishman | |
| 5,670,733 | A | 9/1997 | Fishman | |
| 6,078,006 | A | 6/2000 | Räisänen et al. | |
| 6,242,683 | B1 * | 6/2001 | Raisanen et al. | 84/733 |
| 6,689,948 | B2 * | 2/2004 | Raisanen | 84/733 |

FOREIGN PATENT DOCUMENTS

| | | |
|---|---|---|
| JP | 7-160265 | 3/1993 |
| WO | WO 96/06718 | 3/1996 |

* cited by examiner

*Primary Examiner*—Marlon Fletcher
(74) *Attorney, Agent, or Firm*—Katten Muchin Rosenman LLP

(57) ABSTRACT

Transducer for converting mechanical stress into electric signals, which transducer is composed of at least one electromechanical sheet (107,108) and is capable of converting mechanical stress into electric signals and in which transducer at least one of the electrodes required by the electromechanical sheet is disposed on the surface of one or more thin and flexible dielectric materials, said electrodes (109) forming electrically conductive surfaces of the transducer for connecting the transducer to a signal processing device, said electromechanical sheets being permanently charged cellular electret film and which transducer is constructed of a unitary, thin and flexible layered laminate structure.

9 Claims, 18 Drawing Sheets

TRANSDUCER AND METHOD FOR FORMING A TRANSDUCER

CROSS-REFERENCES TO RELATED APPLICATIONS

The present application is a continuation of U.S. application Ser. No. 09/851,493, filed May 8, 2001, now U.S. Pat. No. 6,689,948 which is a continuation-in-part of U.S. application Ser. No. 09/553,566, filed Apr. 21, 2000, now U.S. Pat. No. 6,242,683, which is a continuation-in-part of U.S. application Ser. No. 09/155,828, now U.S. Pat. No. 6,078,006.

FIELD OF THE INVENTION

The present invention relates to a transducer and, in particular, a flexible, unitary electret film transducer for converting mechanical stress, such as mechanical vibrations, into electric signals, and to a method for its fabrication. The transducer is especially applicable for use for example in musical instruments, such as stringed musical instruments (guitars etc.), and other applications.

PRIOR ART

Transducers for example pickups for acoustic guitars designed to transform string vibrations into electric signals, have a transducer part typically containing different layers of electromechanical transducer elements, dielectric material and electrically conductive electrode layers, and a connection cable part in which the signals are taken to a signal processing unit. Transducers may typically have a one or more transducer element layers. Transducers are typically positioned between a vibrating member and fixed part, for example in acoustic guitar between saddle (vibrating member) and saddle slot (fixed part). Contact transducers are also commonly used for measuring vibration, for example amplifying musical instruments sound, being positioned onto a vibrating member, like for example guitar top, attached by using some sort of adhesive. Typically they consist a piezo ceramic disk or piezoelectric film such as polarized pvdf film.

As electromechanical transducer elements, piezoelectric crystals, piezoelectric film (e.g. polyvinylidene fluoride PVDF) and piezoelectric cable are prior art. In the commonest transducer structures, the connecting cable part is implemented using screened coaxial cable, which is connected to the electrode layers of the transducer part by soldering. Such a transducer is presented e.g. in U.S. Pat. No. 5,319,153. One drawback with this type of structures is the difficulty of fabrication of the transducer and relatively high manufacturing costs, because much of the work has to be done manually. Moreover, the prior art structures typically have separate transducer part and connection cable which means the connections to the preamplifier either have to be made by soldering or by using a mini-plug soldered to the cable. This causes handwork and higher costs.

One major drawback of prior art transducers using crystalline piezoelectric materials is their certain characteristic to produce more of odd harmonic overtones and resonance peaks. In case of acoustic guitar that results to unpleasant sound that is not quite in keeping with the instruments own acoustic sound. Further, the prior art transducers structures comprising many different materials and being relatively thick, the transducers themselves affect to instruments own acoustics sound and thus also to amplified sound.

A dielectric cellular or porous electret film and manufacturing process for same, applicable for use as electromechanical material for a transducer, such as stringed musical instrument transducer, is described in U.S. Pat. No. 4,654,546, said dielectric film comprising permanently charged, biaxially oriented, foamed, usually homogenous film layer containing flat lens-like, shredded or cavitated gas bubbles which can also be called as voids or cells. The electret field, or the permanent electric charge, is achieved by injecting charges into dielectric material. The term "dielectric cellular electret film" is used here to refer to generally cellular type electromechanical films having a permanent electric charge injected into material.

WO-publication 96/06718 presents a procedure for pressure inflation of a pre-foamed plastic film, that makes it possible to manufacture strongly foamed film products, involving a high foaming degree and allowing the thickness of the product to be increased without increasing the amount of plastic material. The improvement in increased velocity of the gas voids from 30% up to 60 and even up to 70% of the thickness results up to 10 fold stronger electromechanical response. This means significantly better signal-to-noise ratio. The term "dielectric swelled cellular electret film" or "pressure inflated prefoamed cellular electret film" is used herein to refer to a foamed film-like plastic product as described in that WO-publication and which is permanently charged in strong electric field i.e. electric charge injected into material.

SUMMARY OF THE INVENTION

The object of the present invention is to eliminate the drawbacks of prior art and achieve an improved transducer of a completely new type, in which a dielectric swelled cellular electret film is used to transform the vibrations or other type mechanical stress into electric signals, instead of piezoelectric materials such as films or crystals. Flat lens-like gas bubbles in the electret film effectively limit the mobility of electret charges in the dielectric material, because the gases have an electric resistance five decades better than the best solid insulating materials have. Compared to hard structure of piezoelectric materials, they act as an elastic soft layer during the conversion of for example string vibrations into electric signals allowing pressure variations caused by vibrations to cause microscopic changes in its thickness. The change in thickness causes the opposite charges on the opposite sides of the voids to get closer or further which causes so called mirror charge over the electrodes arranged over the cellular electret film and thus an measurable electrical output voltage proportional to the force change.

Other object of the invention is to produce a new type of transducer which, due to its elastic charged cellular electret film, is capable of converting mechanical stress, such as string vibrations, into electric signals which, when processed or converted into sound, compared to prior art piezoelectric transducers, results to cleaner signal without resonance peaks based on transducer itself. Because of the elastic swelled cellular core, the young's modulus of the transducer is significantly lower and thus the impedance matching with for example wood is better than with hard piezoelectric materials. This results in cleaner signal which for example in case of acoustic instrument produces acoustic sound without any harshness or "quacking" as typically with piezoelectric materials or in case of analog to digital conversion, easier processor algorithms and more accurate reading.

Another object of the invention is to produce a transducer of a construction thin and flexible to conform both flat and curved surfaces depending on use and application.

Still another object of the invention is to produce a transducer having multiple areas each of them producing own electric signal.

A further object of the invention is to produce a transducer as simple as possible, having no separate transducer part and no separate conductor for connecting it to a signal processing device, but which has a unitary, flexible and laminated structure and connections for connecting it to a signal processing unit.

Also further object of the invention is to produce a new kind accelerometer type contact transducer.

The transducers of the innovation can be very economically fabricated for example by screen-printing the required electrodes with silver paste on sheets of dielectric film (e.g. polyester) and/or directly to electret film, placing several electrodes side by side on the same sheet. By laminating such sheets and dielectric cellular electret film, preferably swelled, on top of each other so that charged dielectric cellular electret film is only placed on a desired area at one end of the sheet while the other end is provided with a connector part with different electrode layers side by side, a laminate sheet is obtained from which the transducers can be cut out e.g. by punching. After that, it is only necessary to join a suitable connector to the electrodes at the connector end of the transducer by pressing mechanically.

With this method, it is possible to produce ultra thin and flexible transducers of desired length, design, shape and width, in which the electrodes in the transducer part are continuous extending from the transducer part to the connecting part and which are unitary, flexible and thin laminate in construction. Fabrication is faster and more economic than with conventional methods. The innovation thus allows an effective and economic production technique of transducers with charged cellular electret film as active material.

In one embodiment of the invention, no dielectric firm plastic layer, where the young's modulus value typically is significantly higher than with cellular electret film, to carry the conductive electrodes, would be needed in the transducer structure adjacent to instrument saddle. Thus the transducer becomes thinner and the acoustic properties become better because the firm plastic layers are not absorbing and dampening the vibration energy. Further, because of saved thickness exclusive firm plastic films, the amount of transducer elements can be increased, without adding too much thickness, and thus the output voltage and therefore the signal-to-noise ratio are further improved. Further, due possible increase in thickness of elastic soft dielectric cellular layers the structure becomes softer which, in case of acoustic guitar transducer, improves the string-to-string balance. Also in this embodiment the electrodes become more durable than screen-printed electrodes and the connectors in the preamplifier end can be easily connected to the transducer so that the there is no plastic layers in between and thus the electrical properties of connections become better and also more durable. Further, it is possible to simultaneously arrange the screening for the connection end and even soldering directly to the electrodes.

BRIEF DESCRIPTION OF THE DRAWINGS

In the following, the invention is described in more detail by the aid of examples by referring to the attached drawings, in which.

DETAILED DESCRIPTION

Figure 1A:
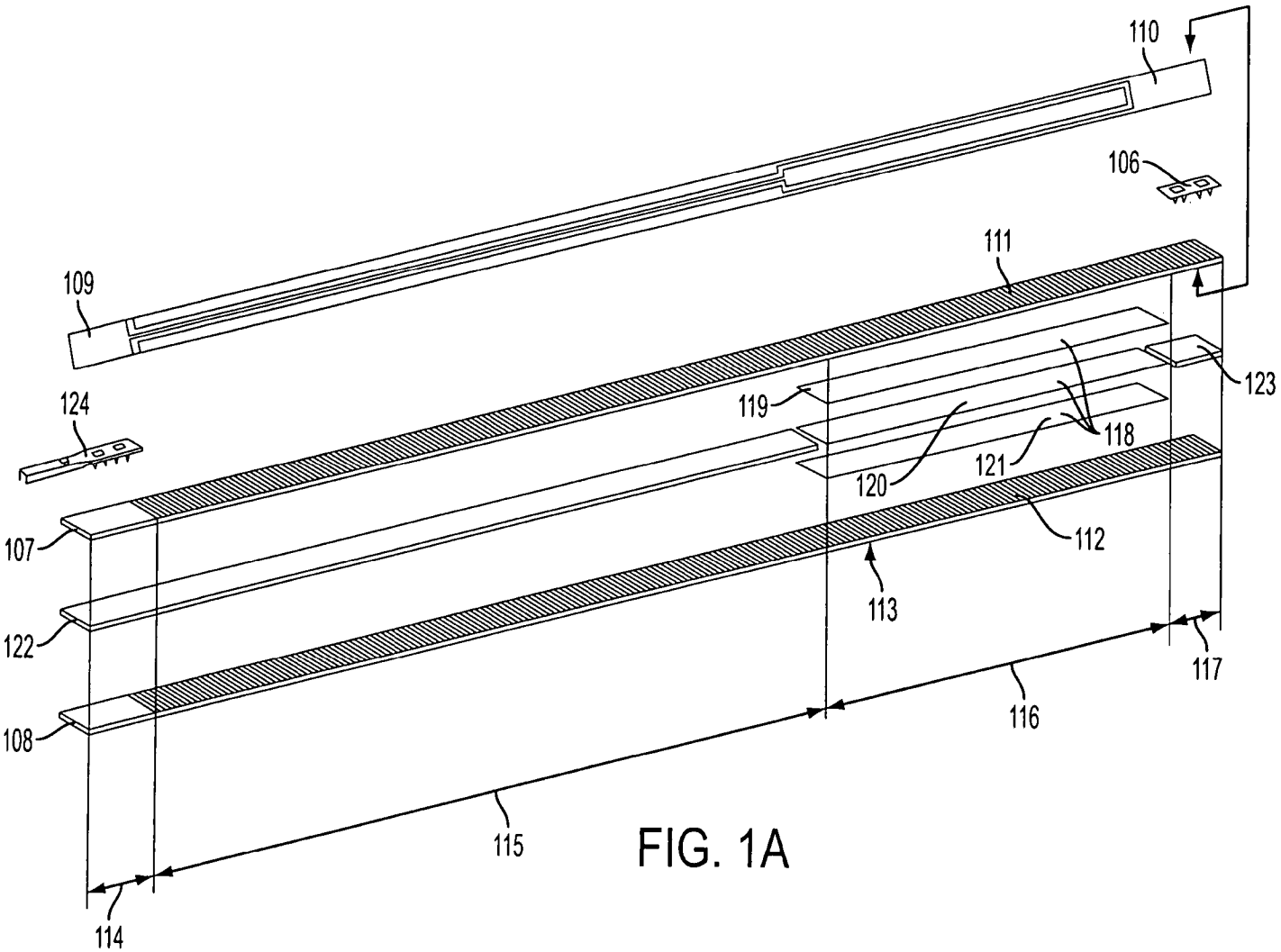
FIGS. 1*a*–1*d* present exploded perspective views illustrating the different components that comprise the transducer of the four different embodiments of the invention.

In the embodiment of FIG. 1*a* the transducer of the invention is composed of sheets 107 and 108 of dielectric film, which may be made e.g. of 0.1 mm thick polyester. On the underside of sheet 107, a signal electrode 109 is screen-printed by using e.g. silver or graphite. Printed around the signal electrode 109 is a ground electrode 110, which reduces electromagnetic interference noise in the signal. It is noted, however, that this ground electrode 110 is not essential to the invention but is also considered as innovative step compared to prior art transducers. Screen-printed on the top surface of film sheet 107 is a ground electrode 111, which may also consist of aluminum foil or other electrically conductive foil suited for the purpose. Screen-printed on the top surface of sheet 108 is a ground electrode 112 and on the bottom surface also a ground electrode 113. It should be noted that this ground electrode 113 is not essential for the structure in this and other embodiments of the invention, where the transducer is not a differential transducer. Sheet 108 may also consist of e.g. thin aluminum or brass foil or other electrically conductive foil suited for the purpose. It is noted that the ground electrodes 110, 111, 112, 113 are shorter at the end 114 pointing towards the preamplifier than the signal electrode 109, whereas at the other end 117 the ground electrodes are somewhat longer than the signal electrode. Instead of being screen-printed, the electrodes may also be for example evaporated e.g. from aluminum onto dielectric films using a mask or etched from a metal/dielectric laminate such as copper/polyamide (for example Kapton®) laminate.

Figure 10:
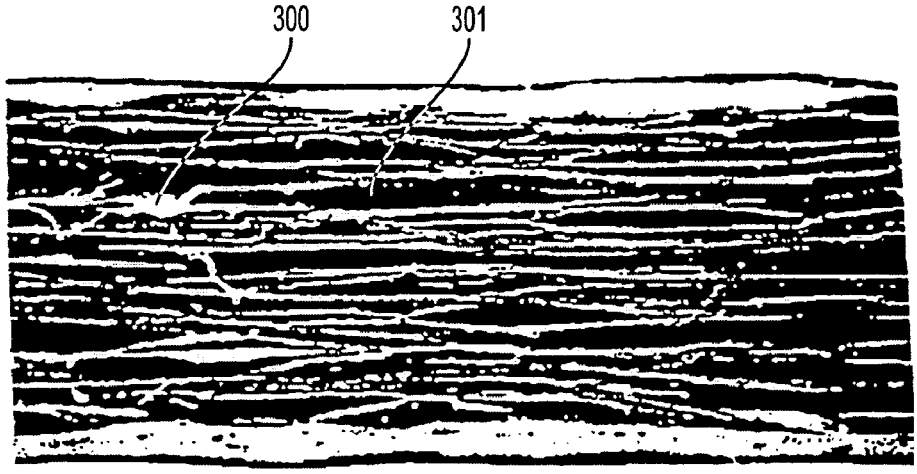
FIG. 10 presents a microscope picture of dielectric cellular electret film.

Between the sheets 107, 108 there is transducer element 118. This element 118 is composed of three, preferably swelled, dielectric cellular electret films 119, 120, 121 having flat gas bubbles 301 inside the film material 300 (FIG. 10). The underside of the topmost film 119 provides negative electric charge. The top side of the intermediate film 120 also has a negative electric charge, while a positive electric charge is provided on its underside. The top side of the bottommost film 121 has a positive electric charge. After being charged, the films have been glued together. The bottommost films 121 bottom side may also be provided with a metallic electrically conductive surface, e.g. evaporated aluminum, which is to be noted is not necessary when the ground electrode is arranged on separate dielectric layer. This electrically conductive surface is possible to have also on topside as well as on one or both sides of films 119 (on topside when ground electrode 110 is not printed) and 120 but it is not recommended. With the procedure described, a maximal electric charge density is achieved. Such an element responds only to the pressure generated and not to bending at all. From the point of view of operation, it is sufficient to have only the intermediate film 120 charged before or after gluing. The transducer element 118 may also consist of two dielectric cellular electret films, in which element 118 opposite polarities of the films 119, 121 are placed against to each other. Such a structure mainly responds to pressure only and very slightly to bending. By placing the films with same polarities facing each other, an element mainly responsive to bending is achieved. For many normal operations, it is sufficient that element 118 be composed of only one dielectric cellular electret film, preferably swelled.

Figure 1B:
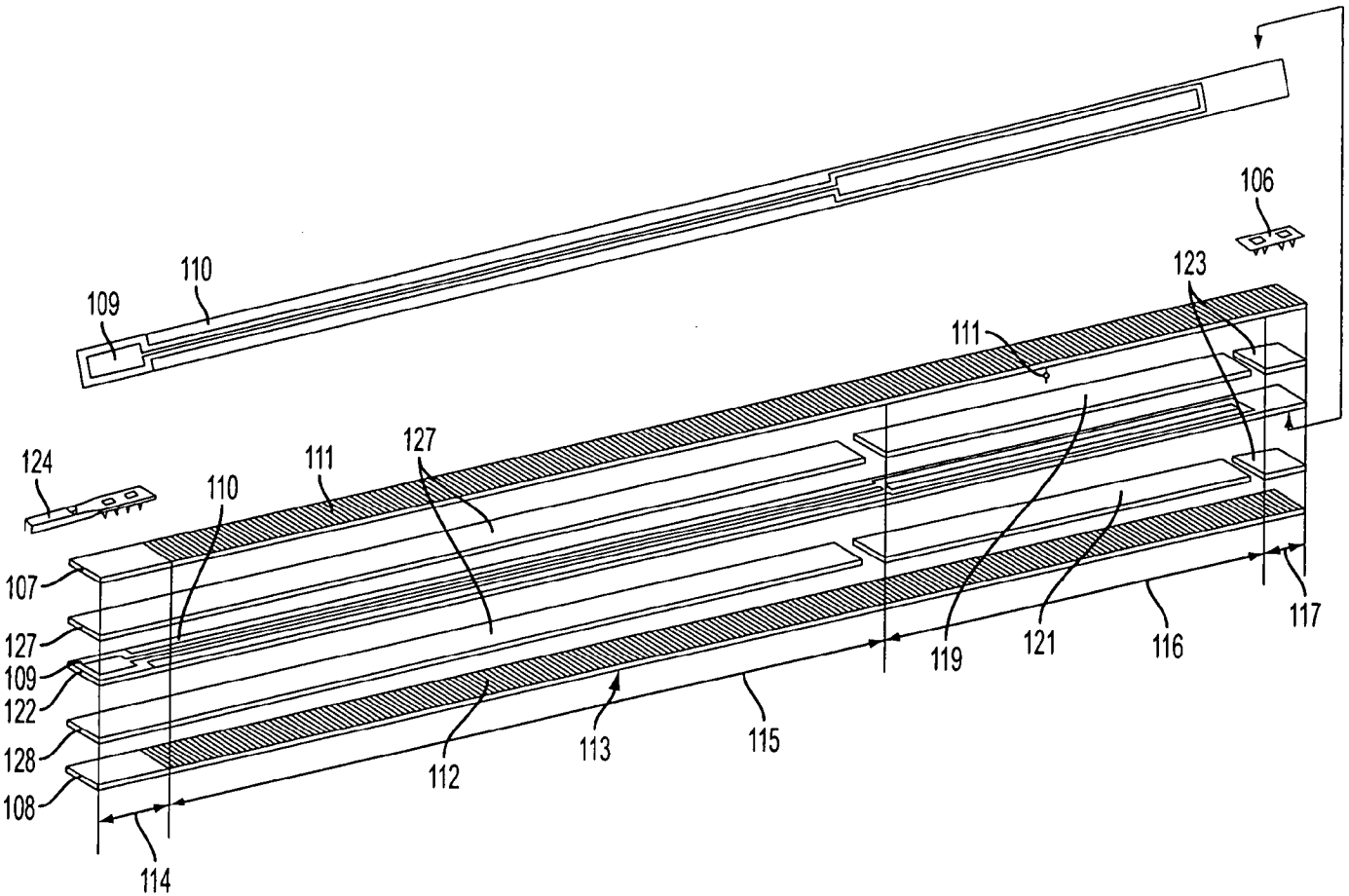

In the embodiment of FIG. 1*b* a transducer of the invention is fabricated in such manner that film 122 is continuous extending through areas 114, 115, 116, 117. Screen-printed on both the top side and on the bottom side of the film 122 is a signal electrode 109 and around it ground electrode 110, which ground electrode is again not essential to the structure. Screen-printed on both the top and bottom side of sheet 107 is a ground electrode 111. Screen-printed on top side of sheet 108 is ground electrode 112 and on the underside another ground electrode 113. Ground electrodes 111, 112, 113, do not extend to area 114. All ground electrodes are connected together by means of a connector 106. Disposed in area 116 above and below sheet 122 are preferably swelled dielectric cellular electret films 119, 121. Positive polarity is on the underside of sheet 119 and on the top side of sheet 121. Negative polarity is on the top side of sheet 119 and on the underside of sheet 121 but it is not essential. By pressing a connector 124 on area 114, the signal electrodes 109 are connected together. At the area 115 between the sheets 107–122 and 122–108 is a dielectrict film 127 to prevent short circuit between signal and ground electrodes. In this embodiment of the invention the dielectrict cellular electret films are connected in parallel.

Figure 1C:
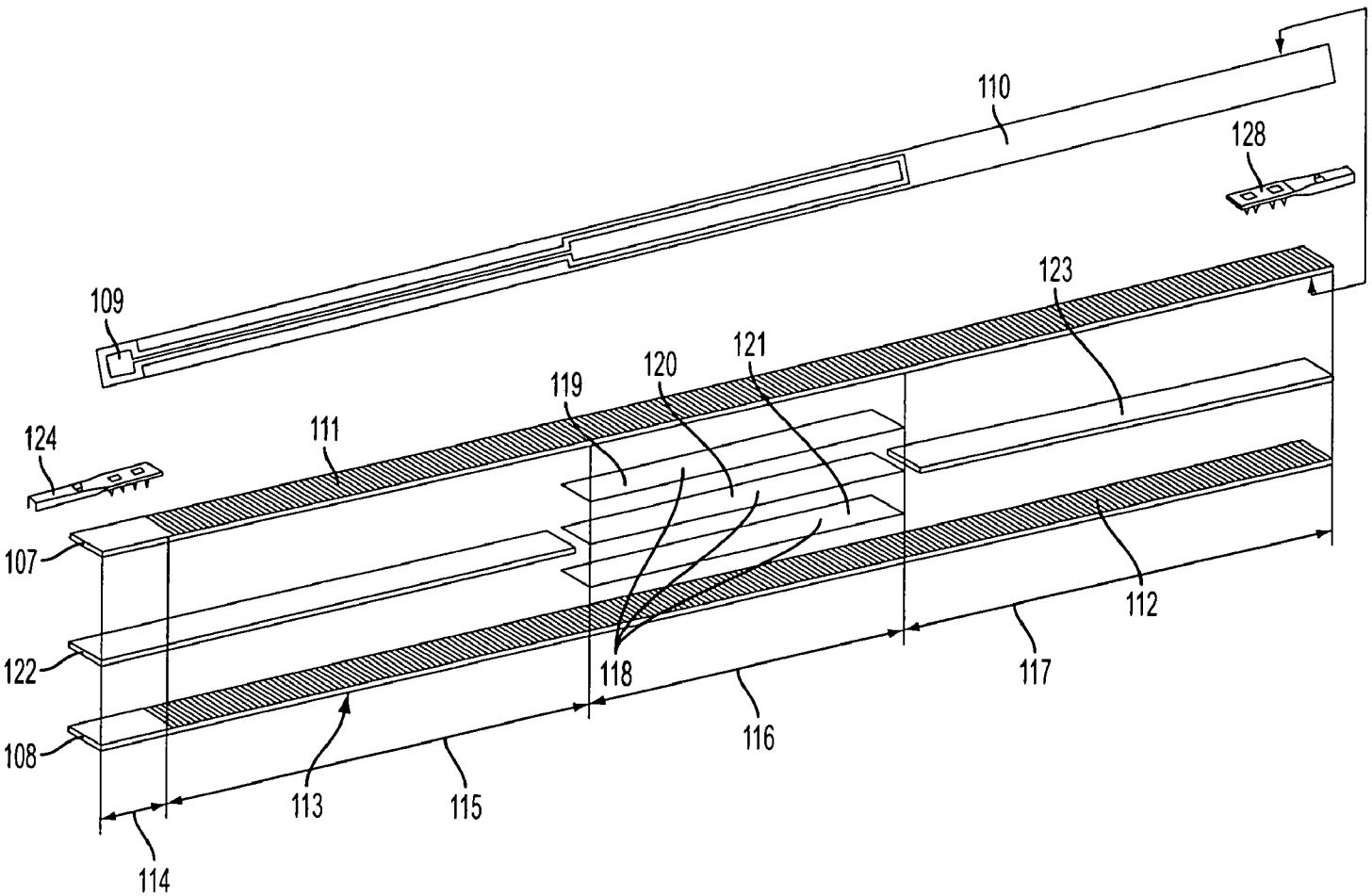
Figures 1D, 1E:
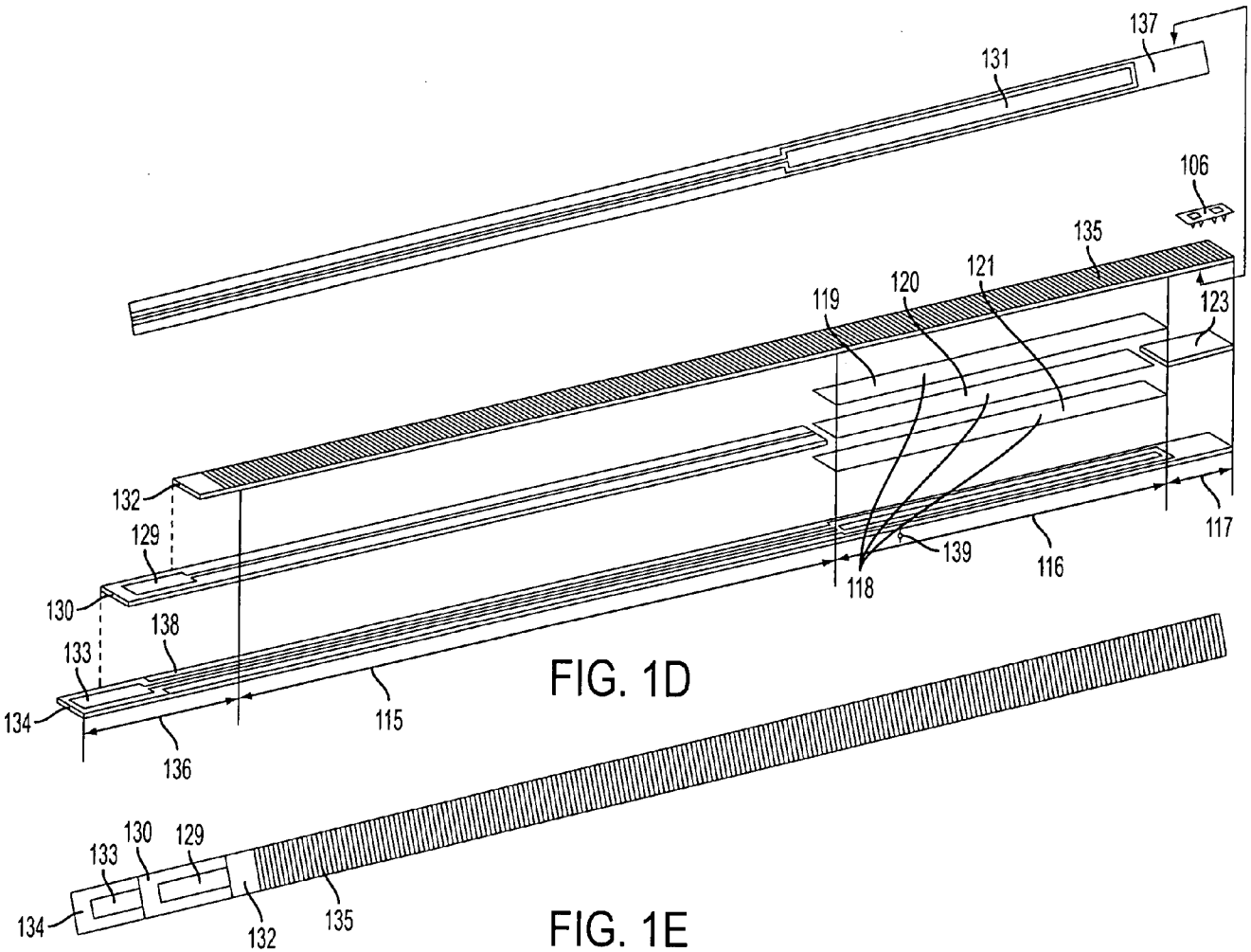
FIG. 1*e* presents top view of the embodiment of the invention presented in FIG. 1*d*, FIG. 2*a* present the signal electrodes and FIG. 2*b* ground electrodes, printed on a sheet of dielectric film, of the transducer of the embodiment in FIGS. 1*a* and 1*b*, FIGS. 3*a*–3*d* present signal electrodes and ground electrodes printed on a sheet of dielectric film of two different embodiments of the invention, the two transducers having different electrodes at the connector end arranged side by side.

In the embodiment of FIG. 1*e* a differential transducer of the invention is implemented by screen-printing signal electrode 129 on the top side of sheet 130 and connecting this signal electrode 129 to the signal electrode 131 using electrically conductive glue between sheets 130 and 132. This signal electrode 129 is made somewhat shorter than the sheet 130 itself. The signal electrode 133 screen-printed on the top side of sheet 134, which is electrically connected to the underside of the bottommost sheet 121 of the element 118, extends to the end of the sheet 134. The ground electrode 135 printed on the top side of sheet 132 is somewhat shorter than the sheet 132. At the transducer end 136, the film sheet lengths are such that sheet 132 is the shortest one of the sheets. Sheet 130 is somewhat longer and sheet 134 is the longest one. At the other end 117 of the transducer is a connector 106 which connects ground electrodes 135, 137, 138, 139 together. It is to be noted again that ground electrodes 138, 139 are not essential to the structure. In this way, an arrangement is achieved in which all signal and ground electrodes of the differential transducer needed to connect to a signal processing device are located sequentially at one end 136 of the transducer and on the same side of it (ref. FIG. 1*e*), enabling it to be connected to the circuit board of a signal processing device by pressing it onto the circuit board at a position provided with corresponding electrodes in sequence. By replacing the signal electrode 133 with an electrode which is printed in the shape of an ground electrode and has a length such that it is shorter at the transducer end 136 than sheet 130 and extends correspondingly to the other end 117 of the transducer, a non-differential transducer is obtained in which the electrodes for connecting the transducer to a signal processing device are on the same side in sequence at one end of the transducer.

Figure 3A:
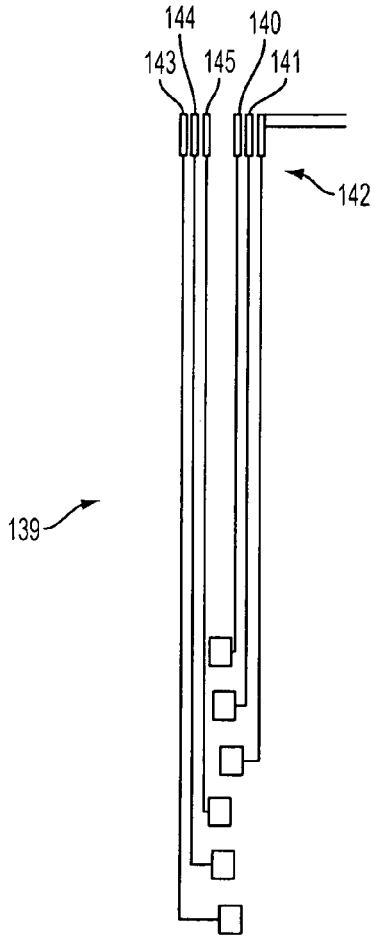
Figure 3B:
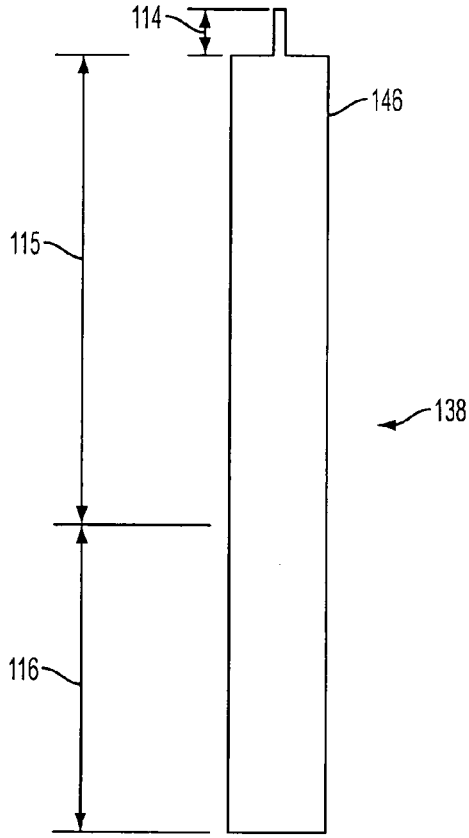
Figure 3C:
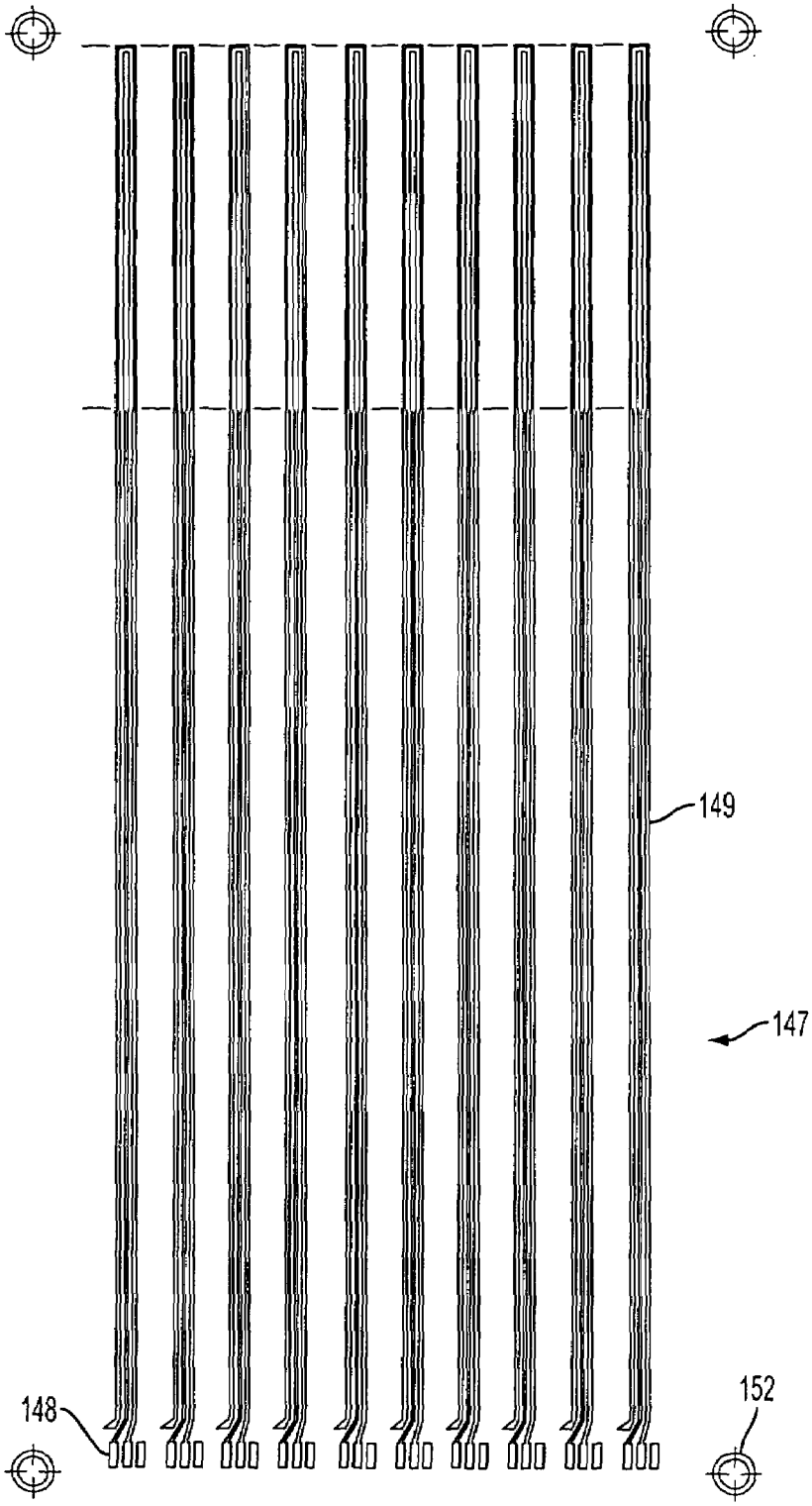
Figure 3D:
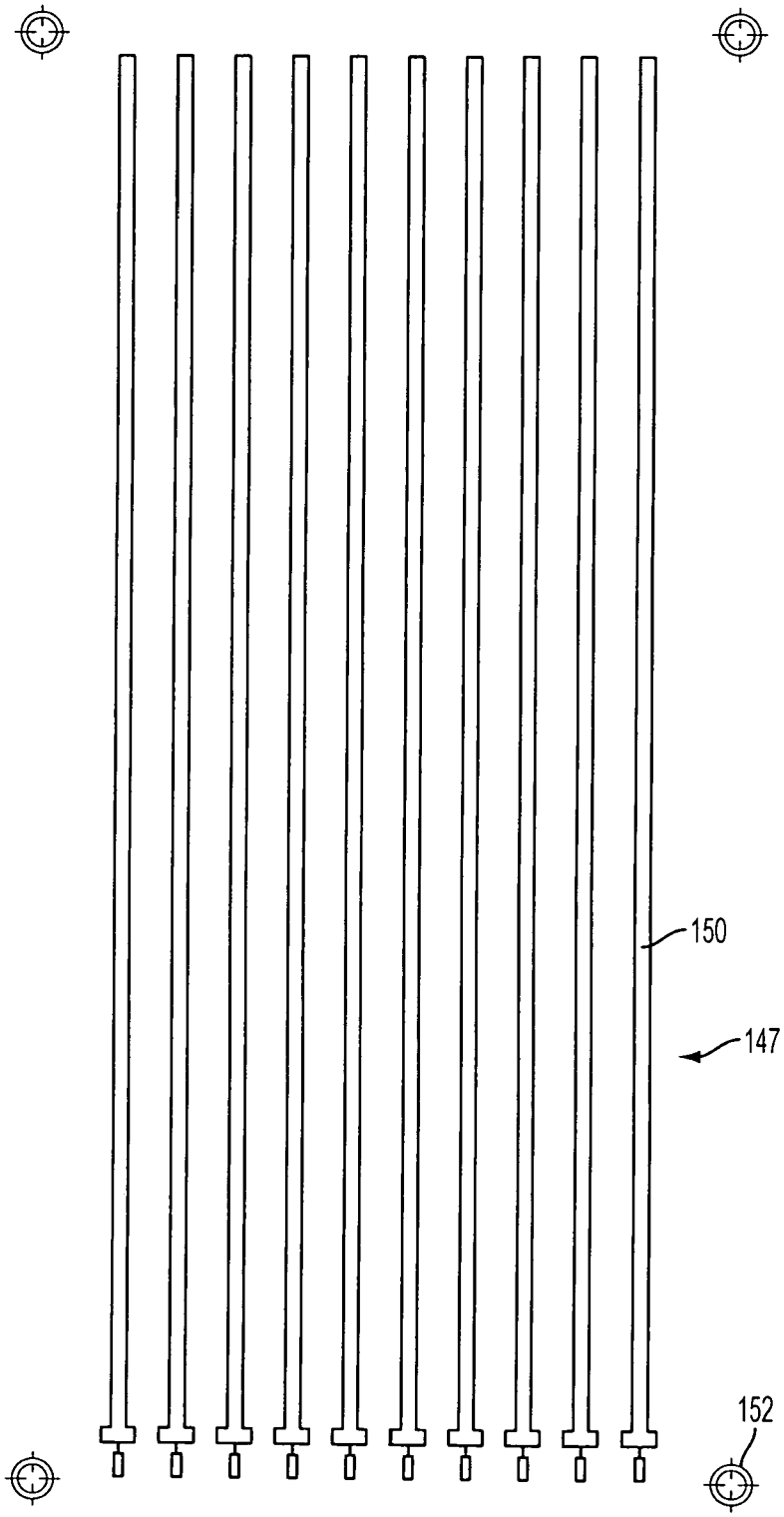
Figure 5:
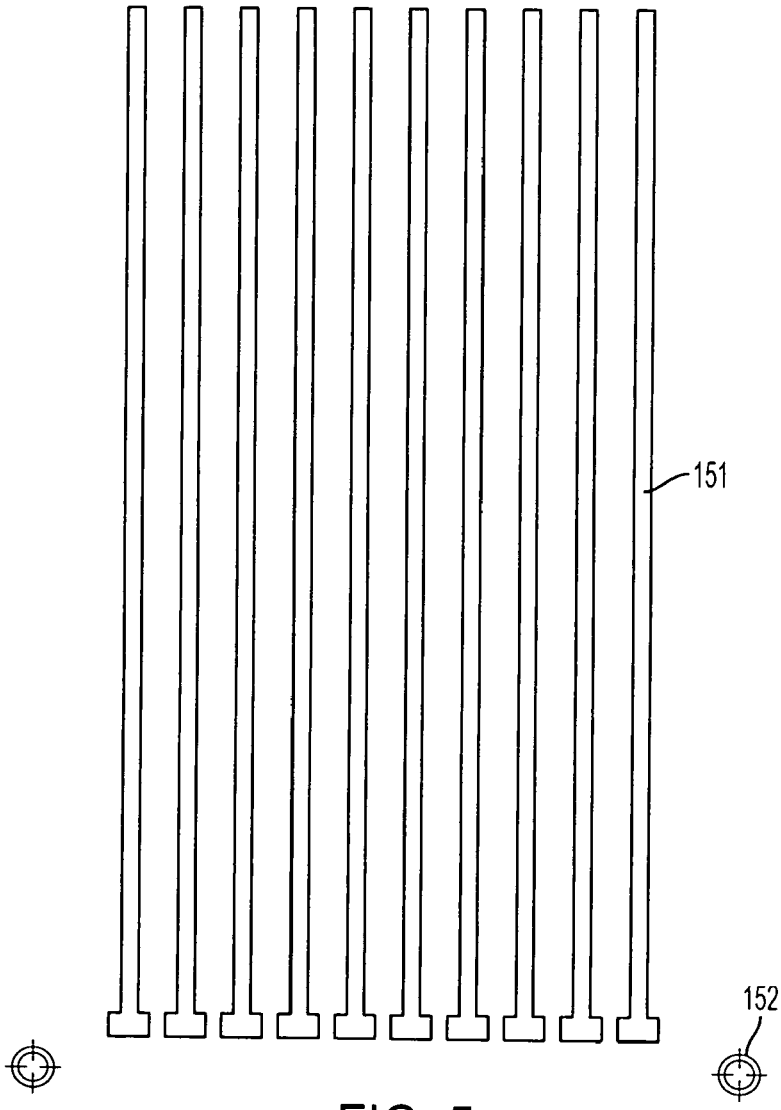
FIG. 5 presents pattern for screen-printing the insulation over the signal and ground electrodes, of the transducer of the embodiment in FIG. 3*c*.

Reference is now made to FIGS. 3*a*–3*d*. If desired, the signal and ground electrodes can also be printed so that they are placed side by side at the transducer end 114 as illustrated by FIGS. 3*a*–3*c*. In FIG. 3*a* there is signal electrodes screen-printed on a dielectric sheet 139 of an embodiment of the invention in which there is a separate signal electrode 140, 141, 142, 143, 144, 145, in this case for each string of a guitar, and particularly for an electric guitar. The vibration of each string of the instrument is transformed into electric signal by the means of having a separate saddle-like piece under each string against disposed signal electrode of the transducer, the charge-signal generated to each electrode being processed separately in the signal processing device. Part of the processing may also include automated gain control for each string. This type of hex-microphone is needed e.g. for making a stereo image or in midi equipment, where the electronics converts the tone pitch into a voltage value controlling a synthesizer. In this embodiment too, the dielectric cellular electret film is placed on the area 116, an insulation is provided in the area 115 and metallic connectors 124 are mechanically pressed through the electrodes in the transducers end 114. In FIG. 3*b* there is the ground electrode 146 screen-printed on a dielectric sheet 138, e.g. polyester of the embodiment described above. In FIGS. 3*c*, 3*d* the pattern for printing the signal and ground electrodes of another embodiment of the invention where the transducer, in this case a differential transducer is obtained having the electrodes side by side at the connector end 114. In that embodiment the pattern shown in FIG. 3*c* shows signal electrodes 148 and around them ground electrodes 149. This pattern is screen-printed say on top side of the dielectric sheet 147 and on bottom side is screen-printed the ground electrodes, as illustrated in FIG. 3*d*. The pattern for screen-printing the dielectric insulation 151 over the electrodes shown in FIG. 3*c* is showed in FIG. 5. Still referring to FIGS. 3*a*–3*b*, when making above mentioned transducer containing several areas to pick up vibrations or stress, so called cross talking can be come a problem. To avoid such it is possible to first print the desired signal electrodes 140, 141, 142, 143, 144, 145, then print a dielectric insulate where the desired areas to pick up vibration are left open and all the leads are covered with insulating material. Then to print a pattern to form a one more ground electrode having same shape as In FIG. 3*b* the ground electrode 146, with exception that holes with narrow space are left over the desired signal areas. In that way the leads from different signal areas to signal processing device will not be picking up undesired charge signals. This kind arrangement, whereby transducer has ground electrodes on both side, the other side having holes and signal electrodes are arranged according the holes, with insulate between ground electrode and signal electrodes, is beneficial in many other applications. In case there are very many signal areas and not enough space is allowable for signal leads, thru-holes can be used for carrying the signal electrode leads on the other side of the dielectric film carrying the signal electrodes.

Figure 2A:
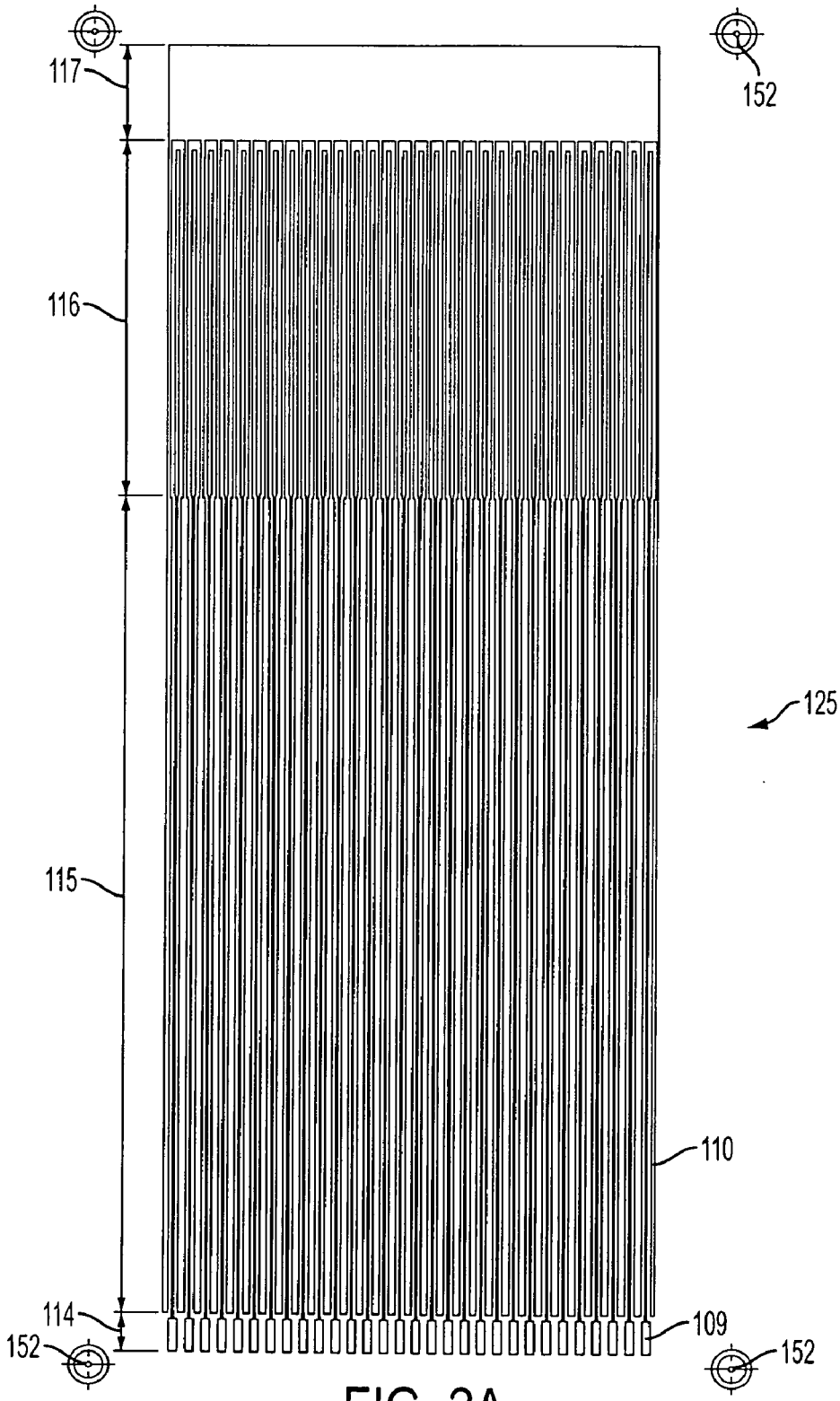
Figure 2B:
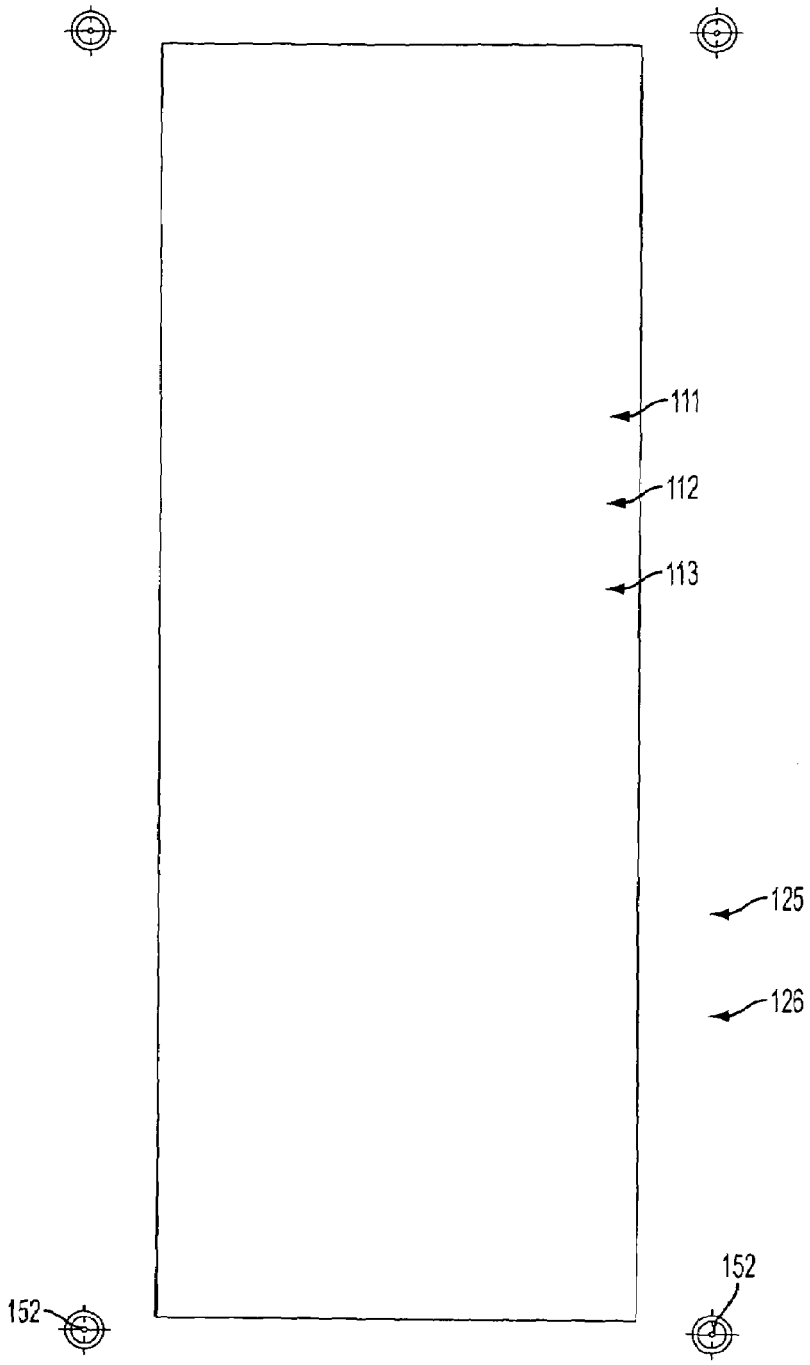
Figure 4A:
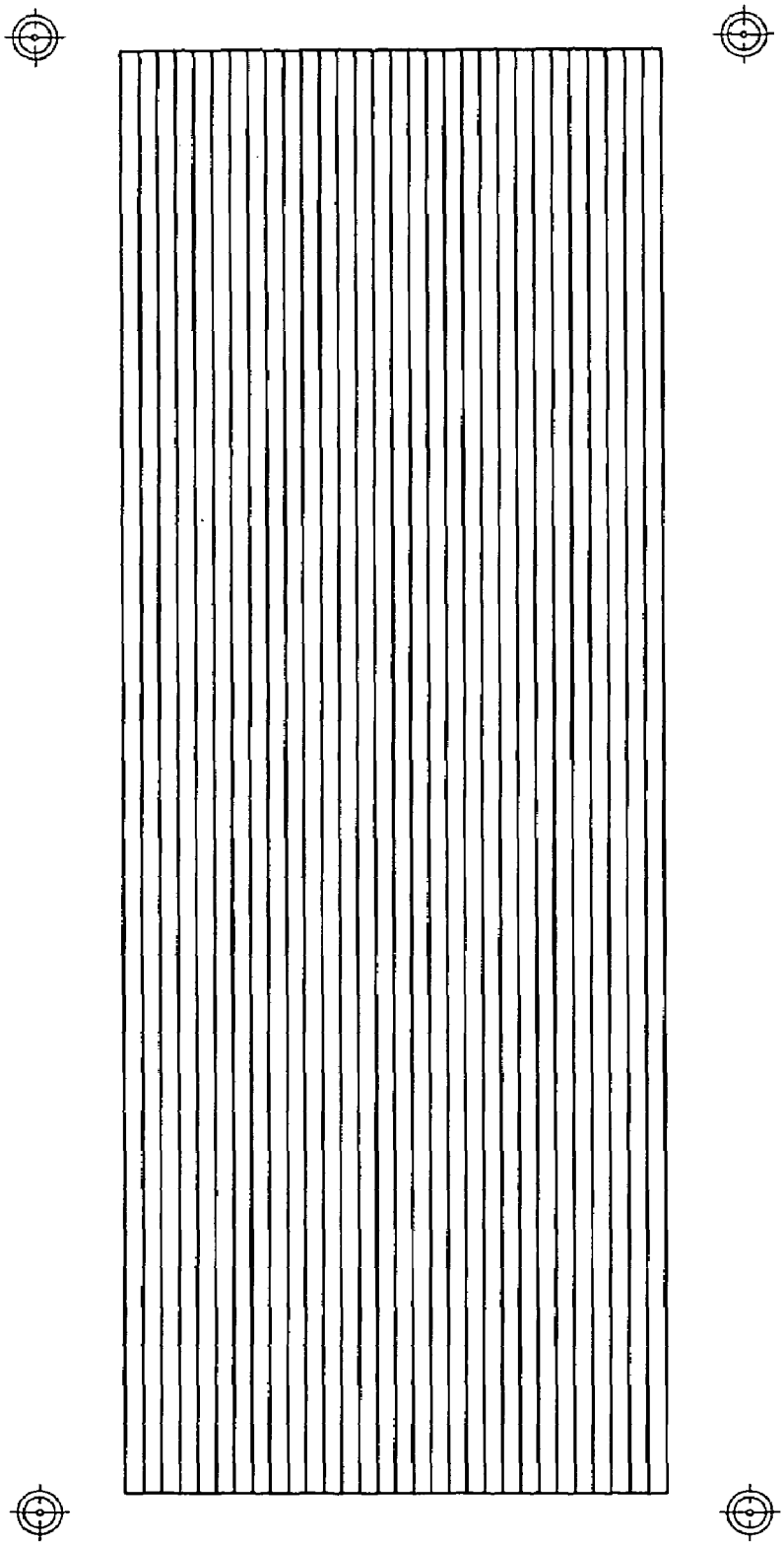
FIGS. 4*a*–4*b* present top view of the cutter blades of a punching unit of the transducer of the embodiment illustrated in FIGS. 1*a*, 1*b*, 3*c*, 3*d*.
Figure 4B:
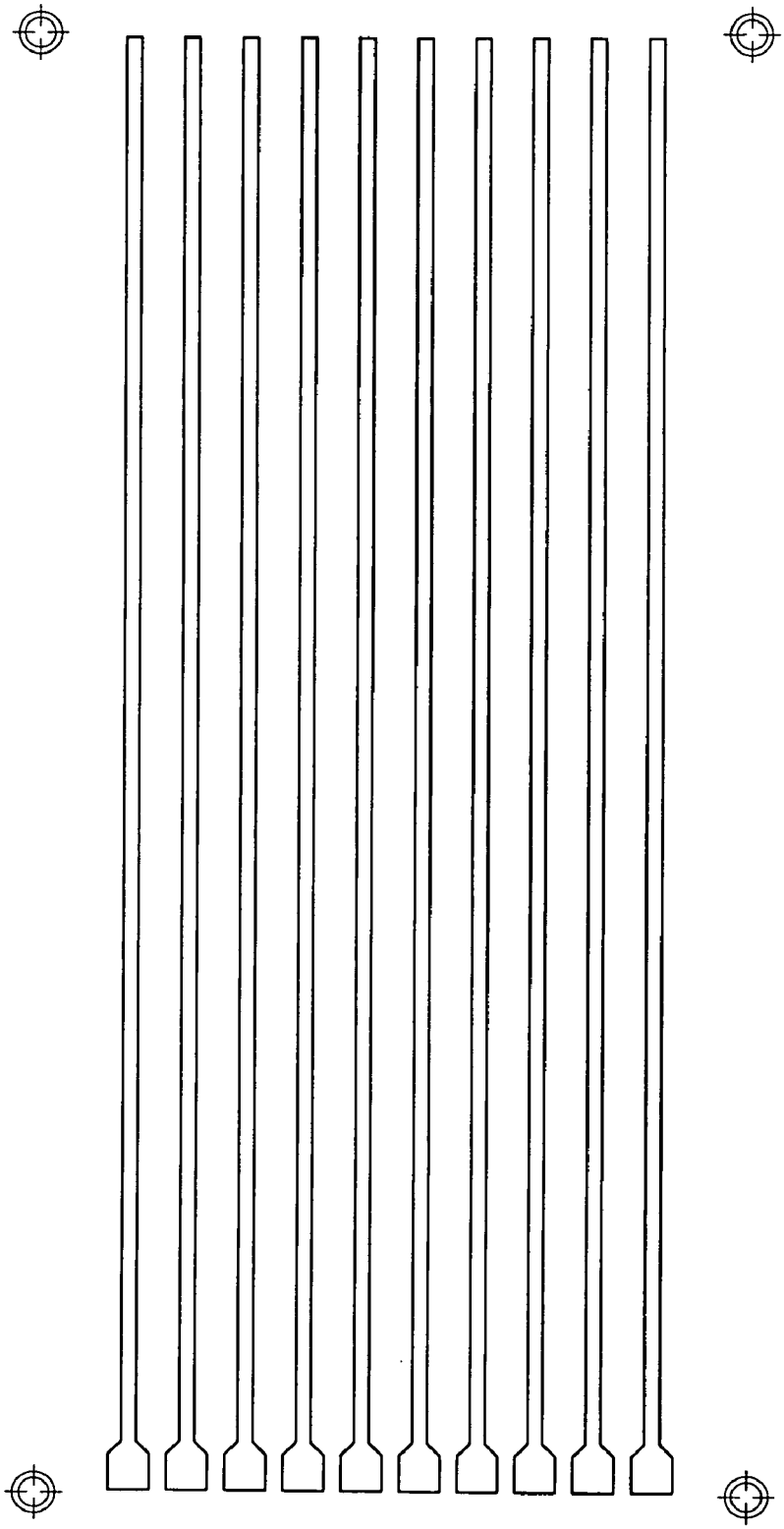

Referring now to FIGS. 1*a*, 1*c*, 2*a*, 2*b*, The transducers of the two embodiments of the invention as shown FIGS. 1*a*, 1*c* are fabricated by first applying suitable glue on the dielectric film 125 on the side where the signal and ground electrodes are screen-printed with silver or graphite paste as shown in FIG. 2*a*. To the other side of this film 125, there are ground electrodes screen-printed as shown in FIG. 2*b*. After this, dielectric sheet cut to suitable size is glued into the area 117. An element 118 size large enough, consisting a laminate of dielectric cellular electret films, preferably swelled, is glued on area 116 and sheet 122 on areas 114, 115. Then glue is applied in the sheet 126 as shown FIG. 2*b*, where there is same ground electrode pattern screen-printed on the both sides of this sheet. The side with glue applied is then glued opposite to the above mentioned laminate, with the register marks 152 in corners in alignment. In this way, a laminate is obtained, from which the transducers can be punched off with a tool as shown in FIG. 4*a*. The transducers can also be cut out from the sheet using e.g. a laser or water jet or some other technique suited for the purpose. This procedure allows a considerably large number of thin and flexible transducers of desired length and width and having a continuous structure without joints than by conventional methods, to be fabricated by the same amount of work while the manufacturing costs remain low.

Figure 6A:
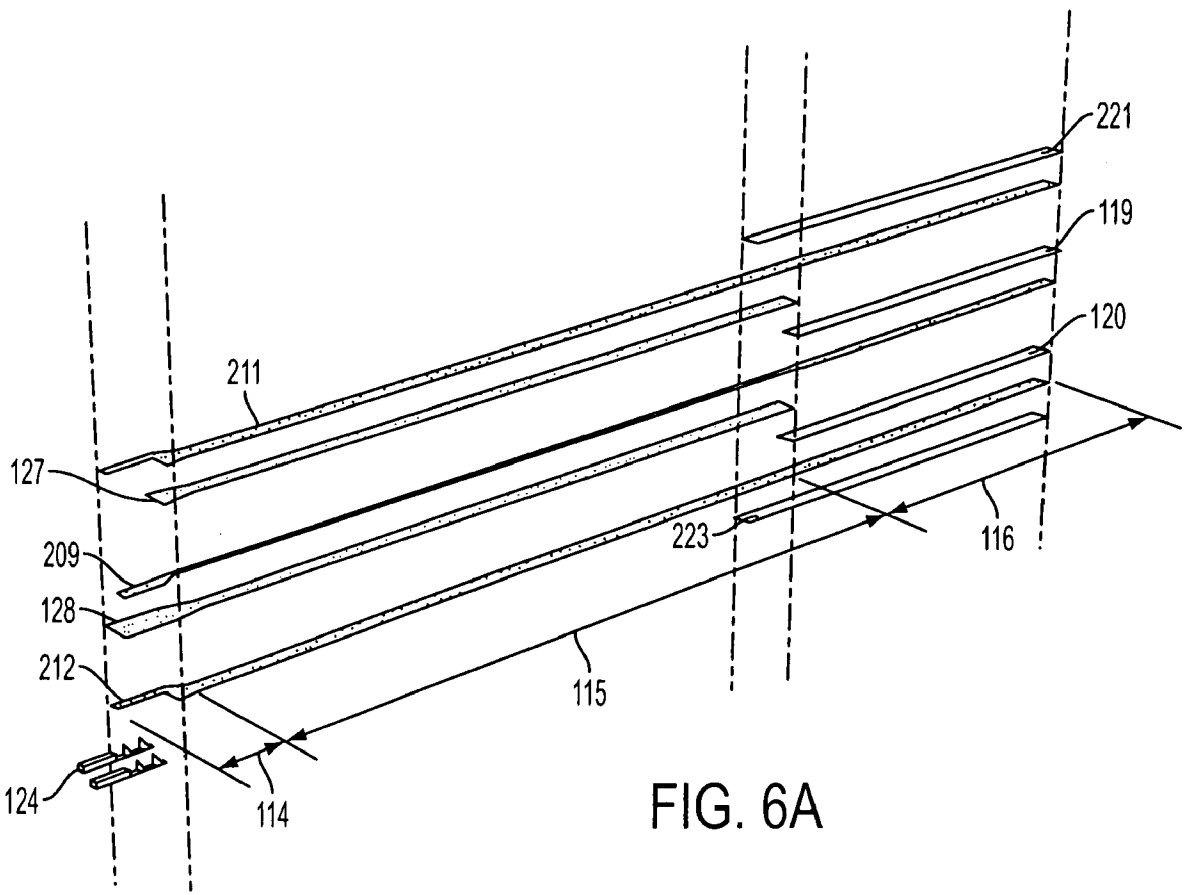
FIG. 6*a* presents an exploded perspective view illustrating the different components that comprise the transducer of the invention without extra dielectric layers carrying the electrodes at the transducer area, with connectors in preamplifier end arranged side by side.
Figure 6B:
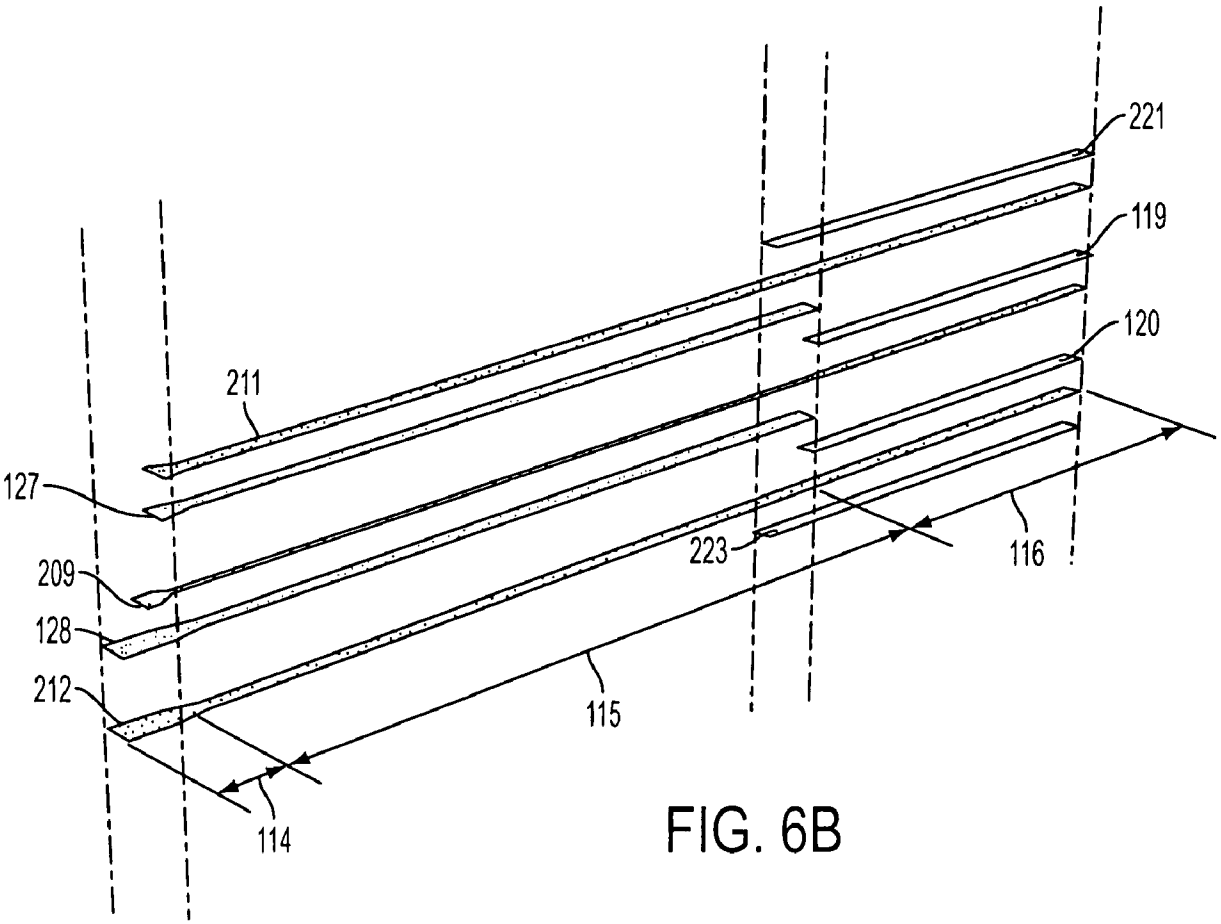
FIG. 6*b* presents an exploded perspective view illustrating the different components that comprise the transducer of the invention without extra dielectric layers carrying the electrodes at the transducer area adjacent to saddle, with sequentially arranged connecting areas in preamplifier end.

The transducers of invention in FIGS. 6*a* and 6*b* consists of a connector part 114 including connectors connecting the transducer to a preamplifier, a connection part 115 corresponding to a connection cable in a conventional transducer and a transducer part 116 for converting vibrations into electric signals. As may be noted the transducers in FIGS. 6*a* and 6*b* have no separate transducer part and no separate conductor for connecting it to a signal processing device, but are of a unitary, flexible and laminated structure extending from the end of transducer part 116 unitary as a connection part 115 up to the connector part 114 and in which the connections for connecting it to a preamplifier can be disposed in sequentially or side by side.

Referring now to FIG. 6*a*, signal electrode 209 is a thin metal film, for example tin-bronze-alloy or tinned copper or aluminium with thickness of preferably 0.035 mm. It is to be noted that many thin metal films and thickness are suitable for the application. On both sides of the signal electrode 209 there are swelled dielectric cellular electret films 119, 120, and on the outer sides of the cellular electret films 119, 120, ground electrodes 211, 212. Signal electrode 209 has a form where the electrode is broad in the transducer part and narrow in the connection part. In the connector part the signal electrode has an area corresponding the connection area of the connector 124. Ground electrodes 211, 212 each comprises of thin metal film. Both the ground electrodes 211, 212 are connected together with a connector 124 in the connector part 114.

Cellular electret films 119, 120 in the transducer area may each comprise of several film layers. Each film 119, 120 is permanently. Preferably positive charges are injected onto the underside of sheet 119 and onto the top side of sheet 120. Negative charges may be injected onto the top side of sheet 119 and onto the underside of sheet 120 but it is not essential. The films 127, 128 in the connection part are preferably uncharged operating thus as isolating film layers between the electrodes. It is also possible to extend the cellular electret films 119, 120 all the way to the connector part 114 but preferably use only partially charged film so that there are no charges in the connection part 115, to avoid the connection part become microphonic and pick-up disturbing vibrations. The ground electrodes 211, 212 can also be sputtered, evaporated, chemically metallized or screen printed to the outer sides of the cellular electret film 119, 120. It is also possible to arrange the signal electrode 209 directly on the face of cellular electret film 119 or 120 by for example chemical metallizing process or simply by screen-printing with silver paste. It is possible to use hybrid structure, with ground electrodes arranged on the surfaces of for example polyester film and signal electrode on the surface of the electret films 119, 120, for example increase the output voltage. It is also possible to use two, or even more, signal electrodes 209 by using three or more transducer elements 119–120 and in between each said element having one signal electrode 209 and at the outermost faces of the outermost transducer elements having the ground electrodes 211–212. Further, by using two signal electrodes, two ground electrodes and three transducer elements, and having the two signal electrodes in connection part arranged side-by-side, an differential transducer can be obtained. It is also possible to arrange the signal electrode in the transducer area to be for example round shape, or oval, or square, or multiple round areas in line, depending on the preferred embodiment.

Figure 9:
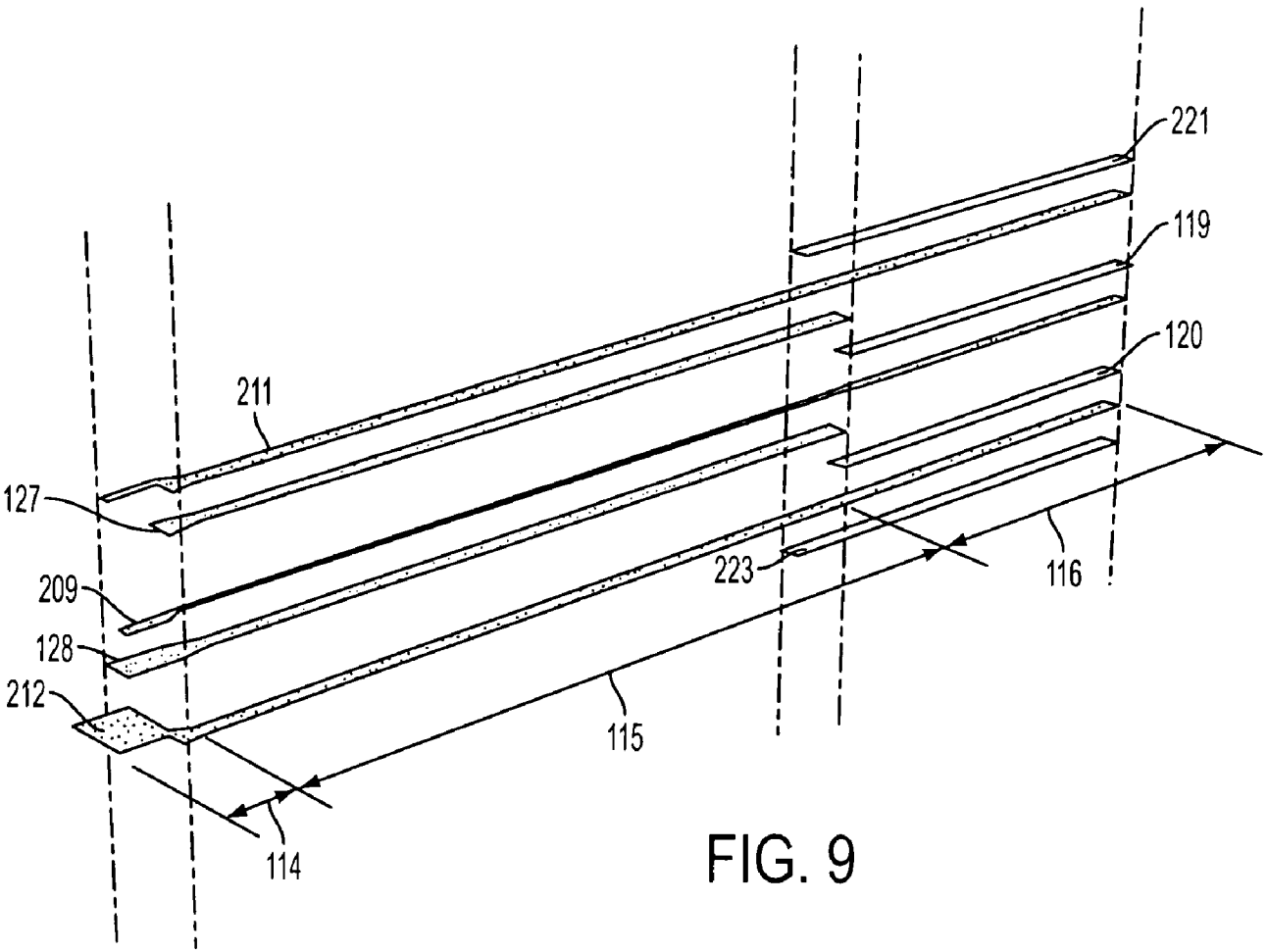
FIG. 9 presents an exploded perspective view illustrating the possible screening of the connector end.

The FIG. 9 shows how the ground electrode 211 may have an extension 224 on the side to form shielding against electrical interference in the connector end 114. Because the connector area in the signal electrode is open for electromagnetic interference, it must be shielded. Typically this is taken care by metal housing of the preamplifier circuitry, but by this way, a very small preamplifier circuitry can be integrated into the connector end. The components of the circuitry, for example one field-effect transistor (FET) and one resistor, are connected to the transducers electrodes 209, 211, 212 and the screening extension 224 is folded around the connector end 114 by using double sided tape 226, which also forms the necessary insulating in between the components and extension 224. It is also possible to integrate or one new USCP packed electret condenser microphone cartridge preamplifier like Maxim 9810 inside the structure. Referring back to FIG. 1*a*, it is even possible to arrange such small preamplifier circuit right after the active area corresponding to transducer element, on the dielectric layer 107, connected to signal electrode 109 and ground electrode 110. Depending on the circuit design, a lay-by maybe necessary and small bowl to the dielectric layer 108 facing cartridge preamplifier. Leads can be connected to the circuitry for taking the signals to the next device in signal processing chain. By having the preamplifier circuitry as close as possible to the transducer element area, the capacitance of the connection part is lowest possible and the signal-to-noise ratio becomes significantly better. This kind arrangement is especially suitable for hex-type transducers as described earlier, where several small signal electrodes facing the transducer element, are arranged, because the smaller transducer the smaller the relative capacitance and thus more important it becomes to have additional capacitances as small as possible, which is avoided by taking the preamplifier circuit as close to transducers as possible.

To make an contact transducer according to invention, simply the transducer area is arranged to be for example round 15 mm diameter disk-like, or multiple round areas in line, or one larger rectangular area, and an weigh, for example 0.1 mm thick copper plate of same shape is glued over the transducer area, on the opposite side of the side which attaches to the vibrating surface. The weigh, which can even be only the transducers polyester layer carrying the electrode, works as mass against which the instrument vibrates and which further causes signal output proportional to the vibration. The less mass, the higher is the transducers own resonance frequency, which is preferred to be above the necessary frequency response.

Figure 7:
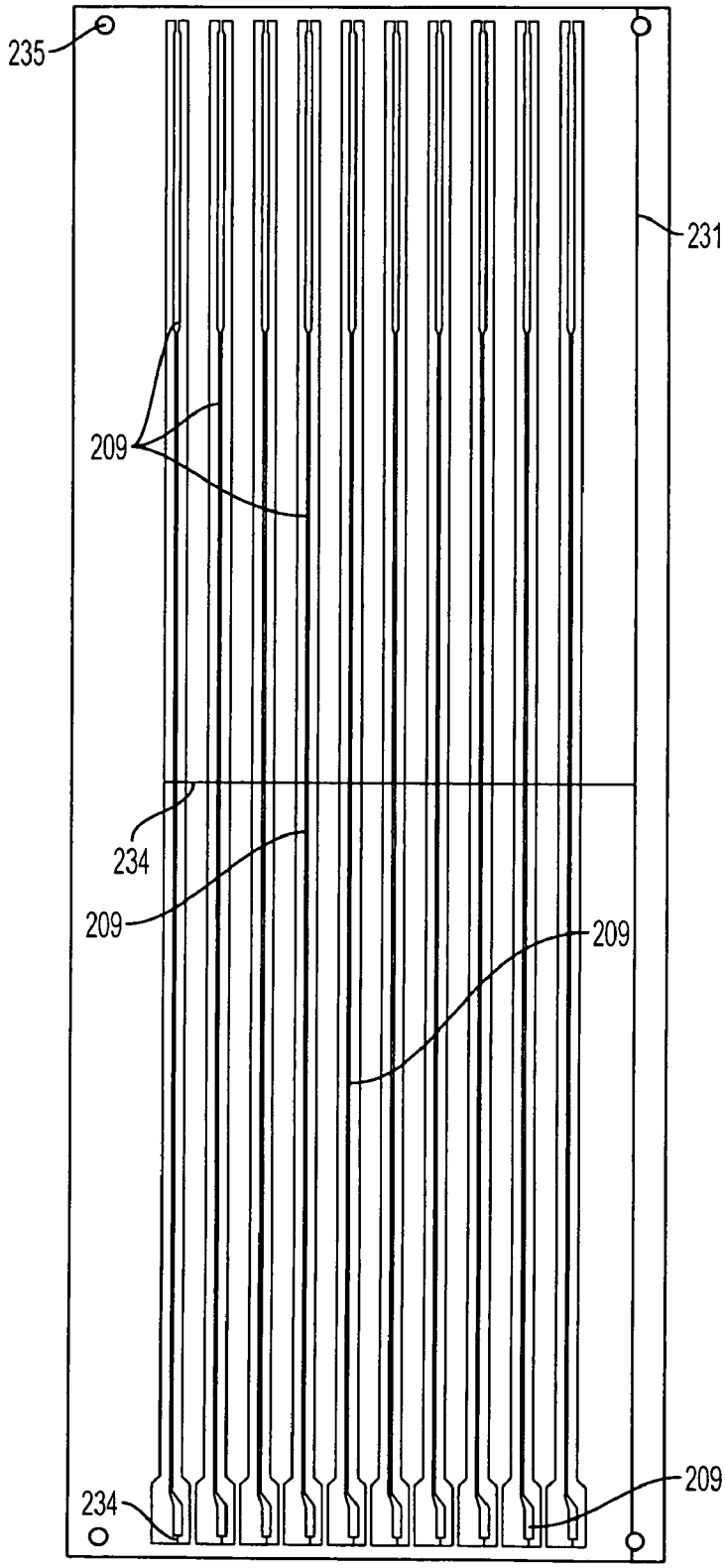
FIG. 7 presents the signal electrodes of the transducer of the embodiment in FIG. 6*a*.
Figure 8:
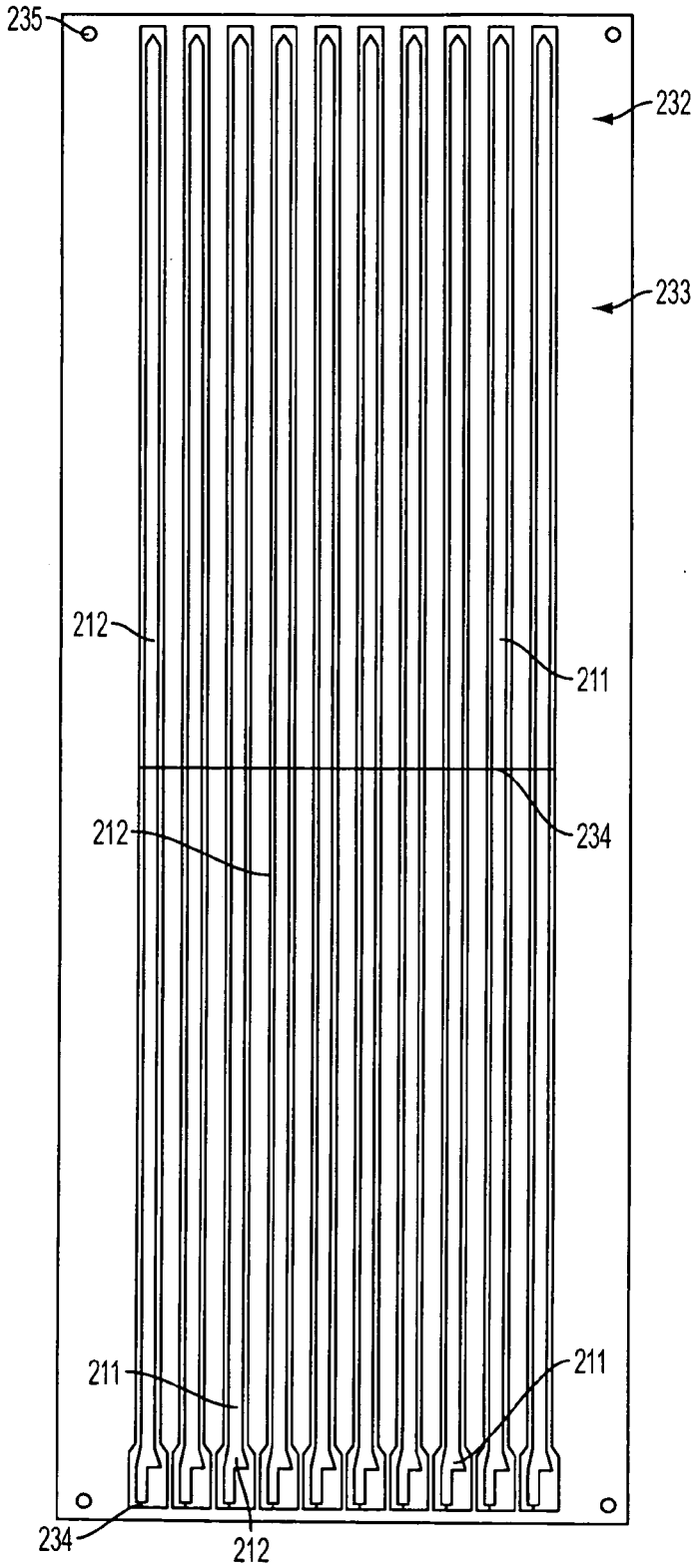
FIG. 8 presents one side ground electrodes of the transducer of the embodiment in FIG. 6*a*.

The transducers in FIGS. 6*a* and 6*b* and 9 are fabricated as follows. Referring to FIG. 7 signal electrodes 209 and ground electrodes 211, 212 are made of a thin metal film 231, 232, 233. Firstly the thin metal film 231, 232, 233 is coated both sides with an insulating material in the areas to form the electrodes. Secondly the metal films 231, 232, 233 are taken into chemical corrode process where all metal except the areas coated with insulating material, is corroded away. Thirdly, the metal film is taken into next chemical process, where the insulating material is removed. After this, a metal film 231, 232, 233, where the wanted electrodes are connected to each others and frame surrounding them with very narrow keepers 234, is remained. In the corners of each metal film 231, 232, 233 there is a hole 235 to ease the assembly. It is to be noted that there is other ways too to make similar metal film 231, 232, 233. One way is to laser cut the same pattern to the metal film, other way is die-cutting the metal film with suitable tool having the same pattern. Water cutting can also be used. By using laser or water cutting, several films can be manufactured simultaneously.

Cellular electret film elements 119, 120 size large enough, consisting typically a laminate of 1–3 dielectric cellular electret films, preferably swelled, and metal films 231, 232, 233 are glued together so that first against metal film 232 with ground electrodes, transducer element 119 and insulating layer 127 are glued, and next, on the other side of the transducer element 119 and insulating layer 127, the metal film 231 with signal electrodes is glued, and next, to the other side of metal film 231, second transducer element 120 and second insulating layer 128 are glued, and next, on the other sides of the transducer element 120 and insulating substrate 128, metal film 233 with second ground layers is glued. In this way a laminate is obtained from which the transducers can be cut away by for example by die-cutting, laser cutting or water cutting. Further the connectors 124 are connected by pressing them to connector end 114.

This procedure allows a considerably larger number of thin and flexible transducers of desired length and width and having a continuous structure without joints than by conventional methods to be fabricated by the same amount of work while the manufacturing costs remain low. Further, referred to the FIGS. 6*a* and 6*b*, the transducers can be manufactured very thin without any extra flexible firm insulating substrates to carry the electrodes.

It is also possible to arrange the electrodes 209, 211, 212 directly onto the cellular electret films 119, 120 by using for example screen-printing, evaporating, sputtering or chemical metallizing.

It is obvious to the person skilled in the art that different embodiments of the invention are not restricted to the examples described above, but that they can be varied within the scope of the claims presented below. The number of films and layers on top of each other can be chosen in accordance with the need in each case; there can be multiple transducer areas and area can also have a shape other than rectangular in top view. These transducers can be used in various applications such as musical instruments transducers.

The invention claimed is:

1. A transducer for converting mechanical stress and vibrations into electric signals, said transducer comprising:

at least one transducer element;

at least one dielectric layer on at least one side of the transducer element;

at least one signal electrode; and at least one ground electrode, the transducer having a transducer part and a connection part;

wherein the transducer element is comprising at least one charged cellular electret film;

wherein at least the signal electrode is arranged between the dielectric layer and transducer element; and wherein the signal electrode is essentially inside the transducer structure in order to reduce the electromagnetic interference, wherein a ground electrode is arranged on same face than said signal electrode to circulate the said signal electrode in order to reduce electromagnetic interference.

2. A method for forming a transducer for transforming mechanical stress and vibrations into electric signals, said transducer comprising:

at least one transducer element;

at least one dielectric film on at least one side of the transducer element;

at least one signal electrode, said signal electrode arranged in between the dielectric film and transducer element;

at least one ground electrode;

a transducer part;

a connection part;

wherein the transducer element is comprised of at least one cellular electret film containing a permanent electric charge;

forming signal electrodes of several transducers on one or more dielectric films or on cellular electret film material side by side;

gluing the dielectric films and the cellular electret film material against each other as a laminate so that the cellular electret film is placed in a desired area, said electrodes forming one or more electrically conductive surfaces required at each transducer; and cutting the laminate into several transducers, wherein the cellular electret film is permanently charged before or after cutting.

3. Method for forming a transducer according to claim 2;

wherein a suitable fastening substance is applied in between the first dielectric film and the first side of the electromechanical transducer material, consisting at least one cellular electret film, fastening the first dielectric film and first side of the transducer material together so that the signal electrodes are arranged in between; and fastening, with suitable substance, a second dielectric sheet and the laminate obtained above, the second side of the transducer element against the dielectric sheet, together, with ground electrodes arranged in between the transducer material and dielectric sheet.

4. Method for forming a transducer according to claim 3, wherein a laminate is obtained, from which the transducers are cut out.

5. Method for forming a transducer as defined in claim 4, wherein the cellular electret film is pressure inflated from prefoamed cellular film.

6. A transducer for converting mechanical stress into electric signals said transducer comprising:

at least two transducer elements, said elements having first and second surfaces;

at least one signal electrode layer arranged between two transducer elements, said signal electrode layer being a electrically conductive layer arranged in between the first surfaces of the two transducer film elements;

at least two ground electrode layers, said ground electrode layers being electrically conductive layers arranged against the second sides of the transducer film elements;

said electrodes extend from the transducer part as connection past for connecting the transducer to a signal processing device; and wherein transducer elements are permanently charged cellular electret films, wherein cellular electret films are biaxially oriented foamed film layers.

7. The transducer as defined in claim 6, wherein the cellular electret film is pressure inflated from prefoamed cellular electret film.

8. Method for forming a transducer according to claim 7, wherein a mass is attached on the other side of the said transducer.

9. Method for forming a transducer for transforming mechanical stress or vibrations into electric signals, said transducer comprising:

at least one transducer element;

at least one dielectric film on at least one side of the transducer element;

at least one ground electrode said ground electrode partially covering said transducer element;

said ground electrode arranged in between the first side of said dielectric film and transducer element;

at least one signal electrode, said signal electrode arranged on second side of said dielectric film;

a transducer part;

a connection part;

wherein the transducer element is comprised of at least one cellular electret film containing a permanent electric charge;

forming said ground electrode of several transducers on one or more dielectric films or on cellular electret film material side by side;

arranging dielectric films and the cellular electret film material against each other as a laminate so that the cellular electret film is placed in a desired area, said electrodes forming one or more electrically conductive surfaces required at each transducer and cutting the laminate into several transducers.

* * * * *